US007591154B2

(12) United States Patent
Oh et al.

(10) Patent No.: US 7,591,154 B2
(45) Date of Patent: Sep. 22, 2009

(54) DRUM TYPE WASHING MACHINE AND VAPOR GENERATOR THEREOF

(75) Inventors: Soo-Young Oh, Seoul (KR); Kyung-Chul Woo, Seoul (KR); Si-Moon Jeon, Seoul (KR); Jin-Woong Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 846 days.

(21) Appl. No.: 10/752,005

(22) Filed: Jan. 7, 2004

(65) Prior Publication Data

US 2005/0034487 A1 Feb. 17, 2005

(30) Foreign Application Priority Data

Aug. 13, 2003 (KR) ..... 10-2003-0056225

(51) Int. Cl.
*D06F 39/04* (2006.01)

(52) U.S. Cl. ..... 68/15

(58) Field of Classification Search ..... 134/105, 134/108; 68/15; 122/379; 392/324–337, 392/386–406
See application file for complete search history.

(56) References Cited

U.S. PATENT DOCUMENTS 1,852,179 A * 4/1932 McDonald ..... 68/183
1,946,278 A * 2/1934 Elfving ..... 68/192
2,216,388 A * 10/1940 Hampel ..... 134/47
2,322,390 A * 6/1943 Rehm ..... 122/347
2,347,490 A * 4/1944 Legeman ..... 236/44 C
2,395,968 A * 3/1946 Hiort AF Ornas ..... 134/56 D
2,470,066 A * 5/1949 Calabrese ..... 174/152 R
2,562,843 A * 7/1951 Grondahl ..... 392/312
2,791,672 A * 5/1957 Steen ..... 392/323
3,025,381 A * 3/1962 Pickering ..... 392/401
3,072,128 A * 1/1963 James ..... 134/57 D
3,304,149 A * 2/1967 Pile ..... 422/114
3,512,412 A * 5/1970 Weining ..... 73/295
3,657,556 A * 4/1972 Foster ..... 307/118
3,743,780 A * 7/1973 Camp ..... 392/337
3,890,987 A * 6/1975 Marcussen et al. ..... 134/57 D
4,239,956 A * 12/1980 Morton ..... 392/402
4,279,384 A * 7/1981 Yamamoto ..... 239/67
4,287,407 A * 9/1981 Treiber et al. ..... 392/400

(Continued)

FOREIGN PATENT DOCUMENTS

CH 283029 5/1952

(Continued)

OTHER PUBLICATIONS

European Patent Office 0 816 550 Jul. 1997.*

*Primary Examiner*—Frankie L Stinson
(74) *Attorney, Agent, or Firm*—Birch, Stewart, Kolasch & Birch, LLP

(57) ABSTRACT

Disclosed are a drum type washing machine and a vapor generator thereof. The vapor generator of the drum type washing machine comprises: a case provided with a space portion for storing water therein, a water supplying portion for supplying water at one side thereof, and a vapor exhaustion portion for exhausting vapor at another side thereof; a water level detecting means installed at the case for detecting a level of water stored in the case; and a heater installed in the case for heating water stored in the case.

11 Claims, 5 Drawing Sheets

U.S. PATENT DOCUMENTS

| | | | | | |
|---|---|---|---|---|---|
| 4,879,902 | A | * | 11/1989 | Loniello | 73/304 R |
| 4,948,947 | A | * | 8/1990 | Kang | 392/386 |
| 5,063,609 | A | * | 11/1991 | Lorimer | 392/401 |
| 5,140,667 | A | * | 8/1992 | Youngeberg | 392/402 |
| 5,180,438 | A | * | 1/1993 | Hockh et al. | 134/21 |
| 5,290,511 | A | * | 3/1994 | Newman | 422/26 |
| 5,293,761 | A | * | 3/1994 | Jang | 68/15 |
| 5,355,840 | A | * | 10/1994 | Violi | 392/401 |
| 5,365,220 | A | * | 11/1994 | Rasmason | 340/620 |
| 5,447,597 | A | * | 9/1995 | Zimmermann et al. | 156/584 |
| 6,078,729 | A | | 6/2000 | Kopel | |
| 6,243,535 | B1 | * | 6/2001 | Bochud | 392/459 |
| 6,425,198 | B2 | * | 7/2002 | Voss et al. | 38/77.8 |
| 6,577,815 | B1 | * | 6/2003 | Wu | 392/402 |
| 6,789,404 | B2 | * | 9/2004 | Kim et al. | 68/15 |
| 7,021,087 | B2 | * | 4/2006 | France et al. | 68/17 R |
| 2004/0187527 | A1 | | 9/2004 | Kim et al. | |

FOREIGN PATENT DOCUMENTS

| | | | | |
|---|---|---|---|---|
| CN | 1345389 | A | | 4/2002 |
| DE | 38 00 181 | A1 | | 7/1989 |
| DE | 42 28 591 | | * | 3/1994 |
| EP | 0 438 112 | A2 | | 7/1991 |
| EP | 0 772 000 | A1 | | 5/1997 |
| EP | 1 023 866 | A1 | | 8/2000 |
| EP | 1 199 515 | A1 | | 4/2002 |
| EP | 1275767 | A1 | | 1/2003 |
| EP | 1 300 503 | A1 | | 4/2003 |
| FR | 2 421 340 | A | | 10/1979 |
| FR | 2 544 054 | | * | 10/1984 |
| GB | 21286 | | | 8/1898 |
| GB | 799788 | A | | 8/1958 |
| GB | 2 079 908 | A | | 1/1982 |
| GB | 2348213 | A | | 9/2000 |
| JP | 61-128995 | | * | 6/1986 |
| JP | 1-169208 | | * | 7/1989 |
| JP | 5-52371 | A | | 3/1993 |
| JP | 9-75215 | A | | 3/1997 |
| JP | 9-79501 | | * | 3/1997 |
| JP | 10-005782 | A | | 1/1998 |
| JP | 10-253006 | | * | 9/1998 |
| JP | 2000176192 | A | | 6/2000 |
| JP | 2000-266302 | | * | 9/2000 |
| JP | 2003-19382 | A | | 1/2003 |
| JP | 2003019382 | A | | 1/2003 |
| JP | 2003093775 | A | | 4/2003 |
| KR | 10-2003-0056225 | | | 8/2003 |
| RU | 1464619 | | * | 1/1996 |
| WO | WO-03/012185 | A2 | | 2/2003 |

* cited by examiner

DRUM TYPE WASHING MACHINE AND VAPOR GENERATOR THEREOF

This Nonprovisional application claims priority under 35 U.S.C. § 119(a) on Patent Application No. 10-2003-0056225 filed in KOREA on Aug. 13, 2003, the entire contents of which are hereby incorporated by reference.

BACKGROUND OF THE INVENTION

1. Field of the Invention

The present invention relates to a drum type washing machine and a vapor generator thereof, and more particularly, to a drum type washing machine capable of automatically generating vapor by using a water level detecting sensor and capable of injecting wash water into a drum by injecting the generated vapor in the drum with a high pressure or by using a high vapor pressure and a vapor generator thereof.

2. Description of the Conventional Art

FIG. 1 is a schematic section view showing a drum type washing machine in accordance with the conventional art.

As shown, the conventional drum type washing machine 10 comprises: a cabinet 11 for forming an appearance; a tub 12 arranged in the cabinet for storing wash water; a drum 13 rotatably arranged in the tub 12 for washing and dehydrating laundry; and a driving motor 14 arranged at a rear side of the tub 12 and connected to a rotation shaft 13*a* of the drum 13.

However, in the drum type washing machine, a device for forcibly circulating wash water is not installed thus to consume a large quantity of water for laundry, and a sterilizer is not installed thus not to be able to sterilize laundry.

SUMMARY OF THE INVENTION

Therefore, an object of the present invention is to provide a drum type washing machine capable of efficiently washing laundry with a small quantity of water by forcibly circulating wash water inside of a drum by using vapor generated from a vapor generator and capable of perform a sterilization function.

Another object of the present invention is to provide a vapor generator of a drum type washing machine for automatically generating vapor by detecting a water level by a water level detecting sensor.

To achieve these and other advantages and in accordance with the purpose of the present invention, as embodied and broadly described herein, there is provided a drum type washing machine comprising: a drum rotatably installed in a cabinet; a driving motor installed at one side of the cabinet for rotating the drum; a vapor generator installed at one side of the cabinet for generating vapor; a diverging pipe installed at an upper side of the drum for supplying vapor generated from the vapor generator to inside of the drum; a first connection hose for connecting the vapor generator and the diverging pipe; a drain pipe installed at a lower side of the drum for draining wash water inside of the drum; a second connection hose for connecting the drain pipe and the diverging pipe; and a circulation pump installed between the second connection hose and the drain pipe for circulating wash water drained from the drum.

A vapor generator of a drum type washing machine according to the present invention comprises: a case provided with a space portion for storing water therein, a water supplying portion for supplying water at one side thereof, and a vapor exhaustion portion for exhausting vapor at another side thereof; a water level detecting means installed at the case for detecting a level of water stored in the case; and a heater installed in the case for heating water stored in the case.

A vapor generator of a drum type washing machine according to the present invention comprises: a case provided with a space portion for storing water therein, a water supplying portion for supplying water at one side of an upper portion thereof, a vapor storing portion for storing vapor at another side of the upper portion thereof, and a vapor exhaustion portion for exhausting vapor at the vapor storing portion; a water level detecting means installed at the case for detecting a level of water stored in the case; a heater installed in the case for heating water stored in the case; and a diaphragm formed at an inner upper surface of the case.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A vapor generator of a drum type washing machine according to the present invention will be explained hereinafter.

Figure 1:
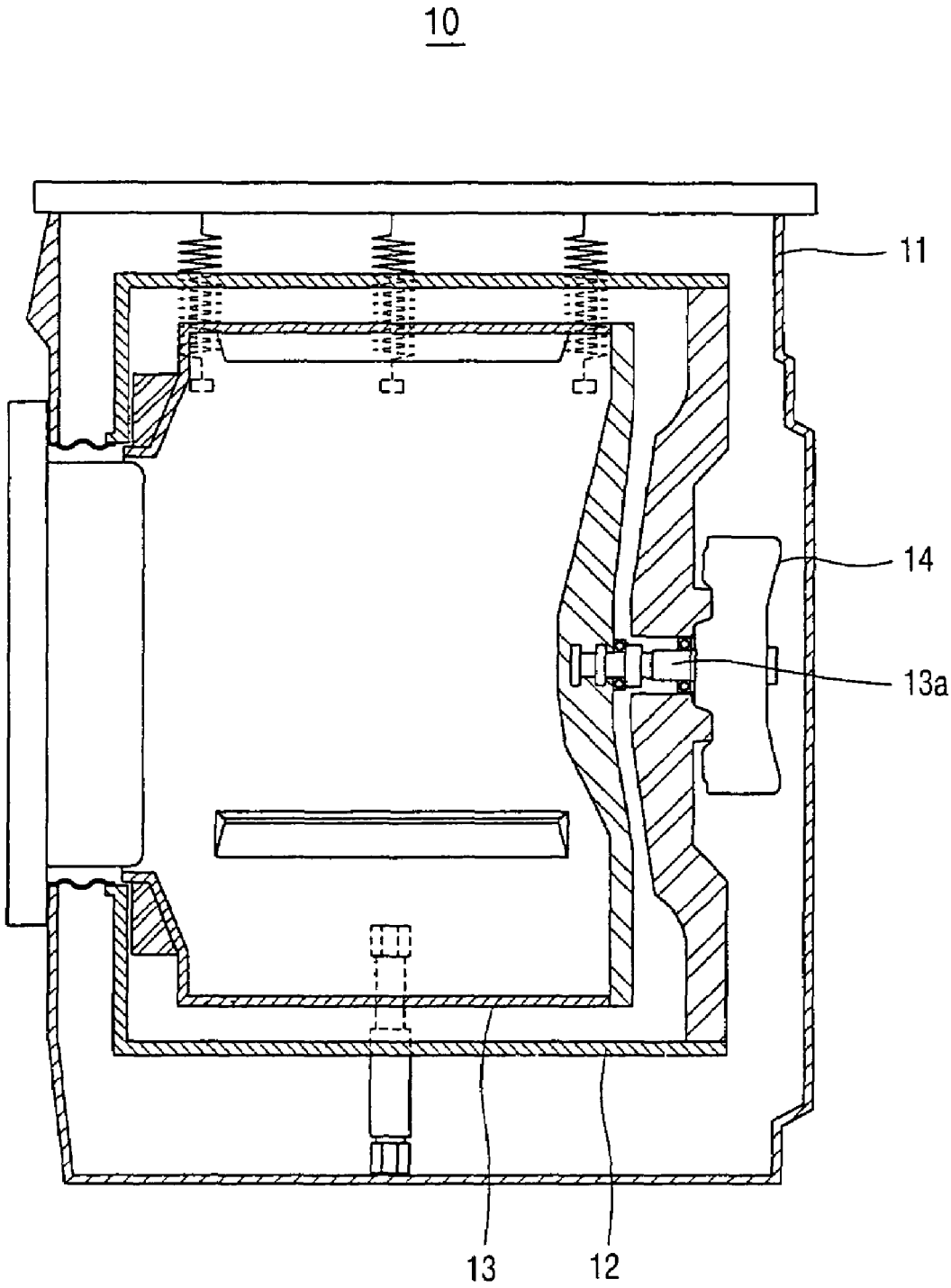
FIG. 1 CONVENTIONAL ART
FIG. 1 is a schematic section view showing a drum type washing machine in accordance with the conventional art.
Figure 2:
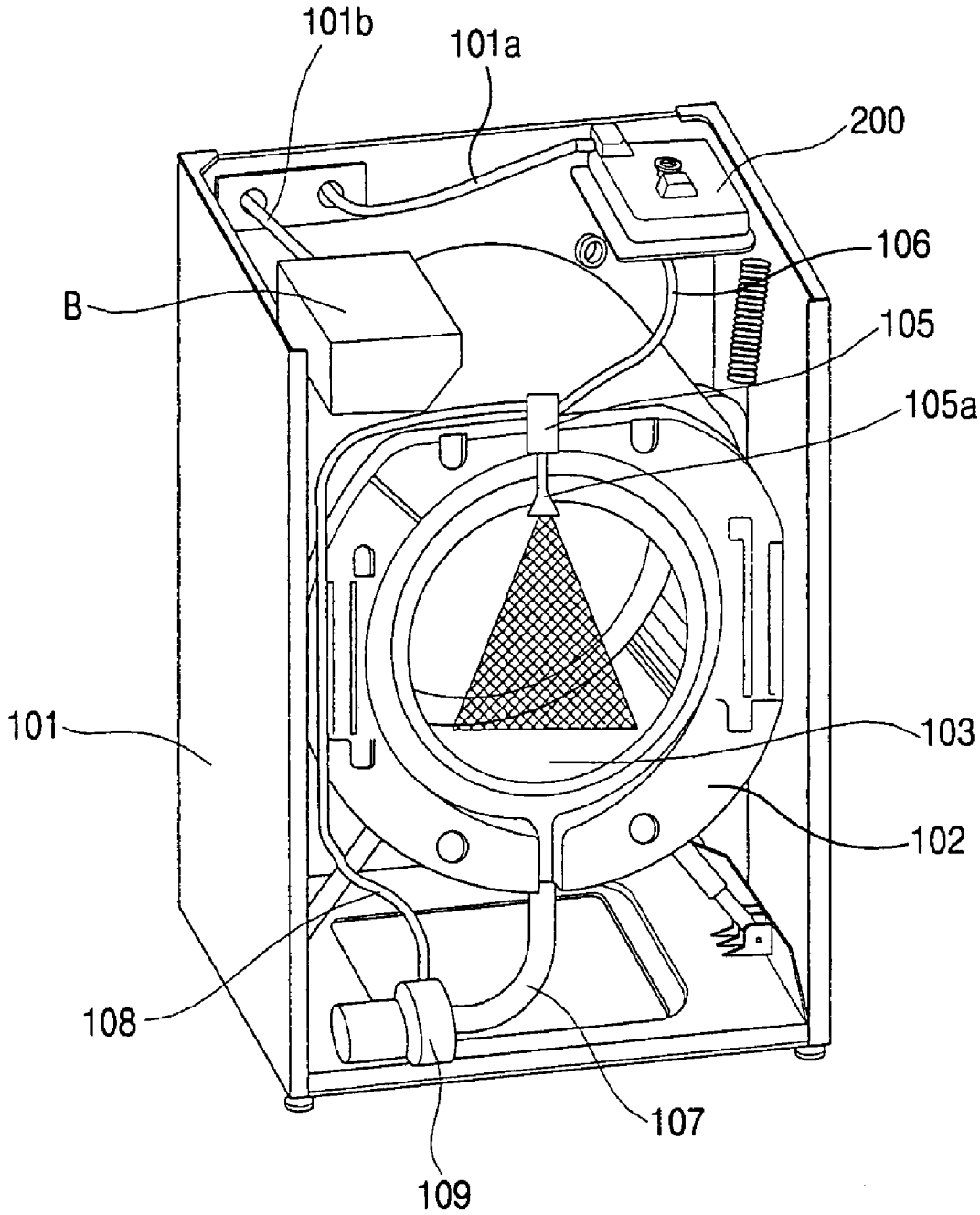
FIG. 2 is a perspective view showing a drum type washing machine according to the present invention.

FIG. 2 is a perspective view showing a drum type washing machine according to the present invention.

As shown, the drum type washing machine 100 comprises: a cabinet 101 for forming an appearance; a tub 102 arranged in the cabinet 101 for storing wash water; a drum 103 rotatably arranged in the tub 102 for washing and dehydrating laundry; and a driving motor (not shown) installed at one side of the cabinet 101 for rotating the drum 102; a vapor generator 200 installed at one side of the cabinet 101 for generating vapor; a diverging pipe 105 installed at an upper side of the drum 103 for supplying vapor generated from the vapor generator 200 to inside of the drum 103; a first connection hose 106 for connecting the vapor generator 200 and the diverging pipe 105; a drain pipe 107 installed at a lower side of the drum 103 for draining wash water inside of the drum 103; a second connection hose 108 for connecting the drain pipe 107 and the diverging pipe 105; and a circulation pump 109 installed between the second connection hose 108 and the drain pipe 107 for circulating wash water drained from the drum 103 into the diverging pipe 105. An injection nozzle 105*a* for injecting vapor with a high pressure is formed at an end of the diverging pipe, and a detergent box B is installed at an upper portion of the cabinet 101.

A first water supplying pipe 101*a* is connected to the vapor generator 200, and a second water supplying pipe 101*b* is connected to the detergent box B.

Figure 3:
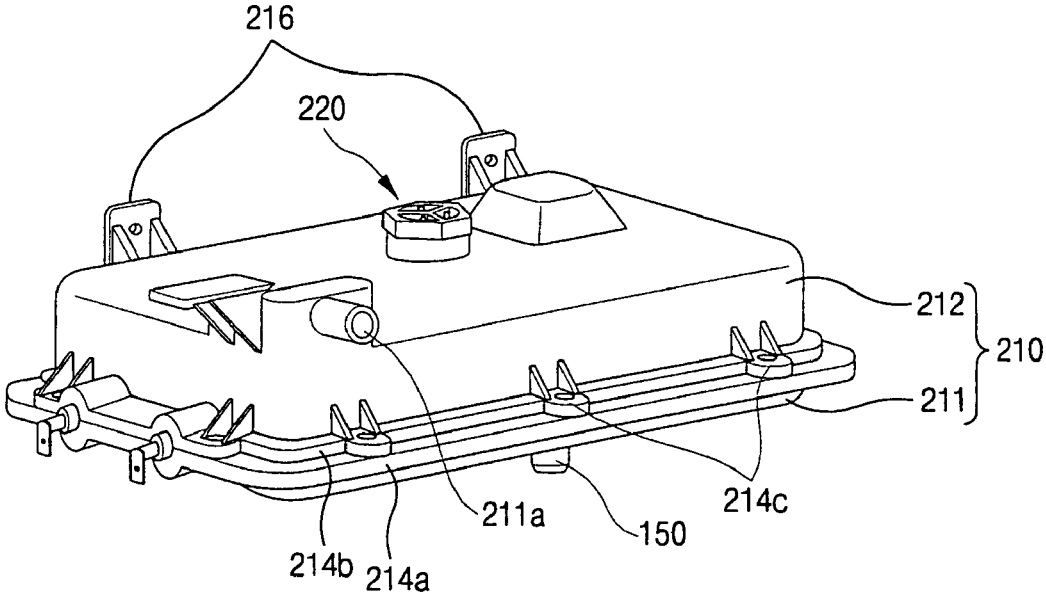
FIG. 3 is a perspective view of a vapor generator of a drum type washing machine according to one embodiment of the present invention.
Figure 4:
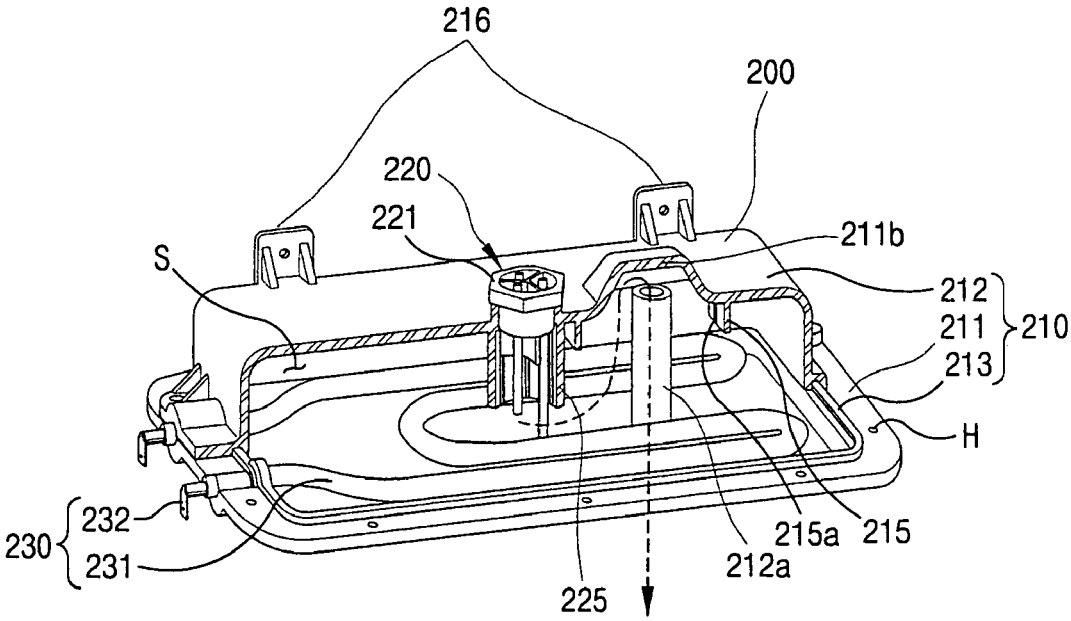
FIG. 4 is a cut perspective view of FIG. 3.
Figure 5:
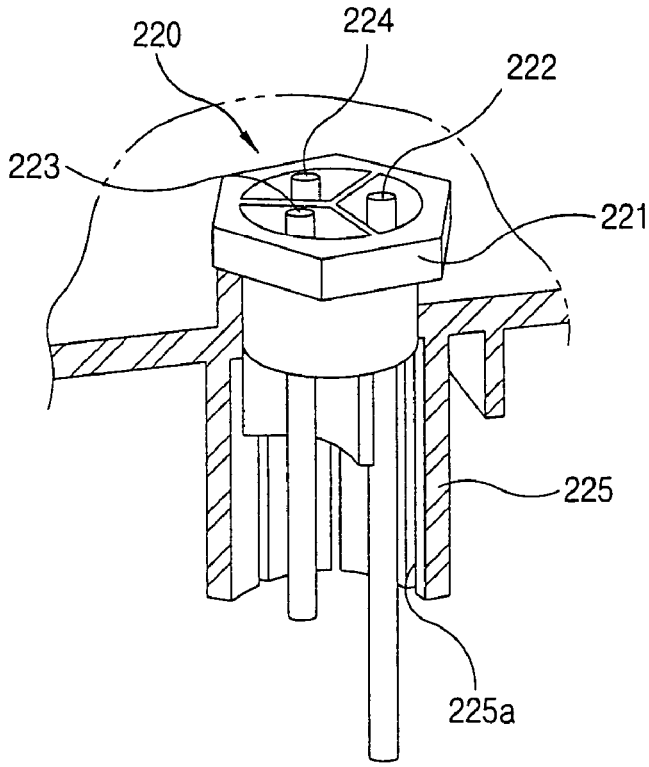
FIG. 5 is a perspective view of an extracted main part showing a water level detecting sensor of FIG. 3.

FIG. 3 is a perspective view of a vapor generator of a drum type washing machine according to one embodiment of the present invention, and FIG. 4 is a cut perspective view of FIG. 3.

As shown, the vapor generator according to one embodiment of the present invention comprises: a case provided with a space portion for storing water therein, a water supplying portion for supplying water at one side thereof, and a vapor exhaustion portion for exhausting vapor at another side thereof; a water level detecting means installed at the case for detecting a level of water stored in the case; and a heater installed in the case for heating water stored in the case.

A vapor generator of a drum type washing machine according to the present invention comprises: a case 210 provided with a space portion S for storing water therein, a water supplying portion 211*a* for supplying water at one side thereof, and a vapor exhaustion portion 212*a* of a pipe shape for exhausting vapor at another side thereof; a water level detecting sensor 220 installed at the case 210 for detecting a level of water stored in the case 210; and a heater 230 installed in the case 210 for heating water stored in the case 210.

The case 210 is composed of a lower case 211 where the heater 230 is installed, an upper case 212 coupled to the lower case 211, a watertight member 213 interposed between the lower case 211 and the upper case 212, and a case coupling means for coupling the lower case 211 and the upper case 212.

The case coupling means is composed of a lower flange portion 214*a* formed at an outer circumferential surface of the lower case 211 and having a plurality of bolt holes H, an upper flange portion 214*b* formed at an outer circumferential surface of the upper case 212 and having a plurality of bolt holes H, and a bolt 214*c* coupled to the bolt hole H.

The lower case 211 and the upper case 212 are coupled to each other by a heat bonding or a supersonic bonding method.

The heater 230 is composed of a heat transmitting pipe 231 arranged at a bottom surface of the lower case 211, and a connector 232 installed at both ends of the heat transmitting pipe 231 to be connected to an external power source (not shown).

A vapor storing groove 211*b* for storing vapor generated by the heater 230 is formed at a position corresponding to the vapor exhaustion portion 212*a* at an inner surface of the upper case 212.

A diaphragm 215 for preventing water inside of the lower and upper cases 211 and 212 from being introduced into the vapor exhaustion portion 212*a* is formed at the inner surface of the upper case 212, and a plurality of slots 215*a* are formed at the diaphragm 215 in a longitudinal direction.

The water level detecting sensor 220 is composed of a body 221 coupled to an upper portion of the upper case 212, three detecting rods 222, 223, and 224 installed at the body 221 with 120° in a longitudinal direction, and a diaphragm 225 having longitudinal slots 225*a* installed at a lower portion of the body 221 for covering the detecting rods 222, 223, and 224.

A surface of water inside of the cases 211 and 212 can be shaken by vibration generated when vapor stored in the vapor storing groove 211*b* is exhausted with a high pressure through the vapor exhaustion portion 212*a*, so that the water level detecting sensor 220 can not accurately measure a water level. Accordingly, it is preferable that the water level detecting sensor 220 and the vapor exhaustion portion 212*a* are positioned to be separated from each other as much as possible.

It is supposed that the longest rod among the detecting rods 222, 223, and 224 is the first detecting rod 222, a middle rod is the second detecting rod 223, and the shortest rod is the third detecting rod 224.

According to this, a water supply time point inside of the cases 211 and 212 and an 'on' time point of the heater 230 are detected by the first and third detecting rods 222 and 224, and an 'off' time point of the heater 230 is detected by the first and second detecting rods 222 and 223.

A mounting bracket 216 for coupling the cases 211 and 212 to the cabinet 101 by a bolt is formed at one side of the cases 211 and 212.

Figure 7:
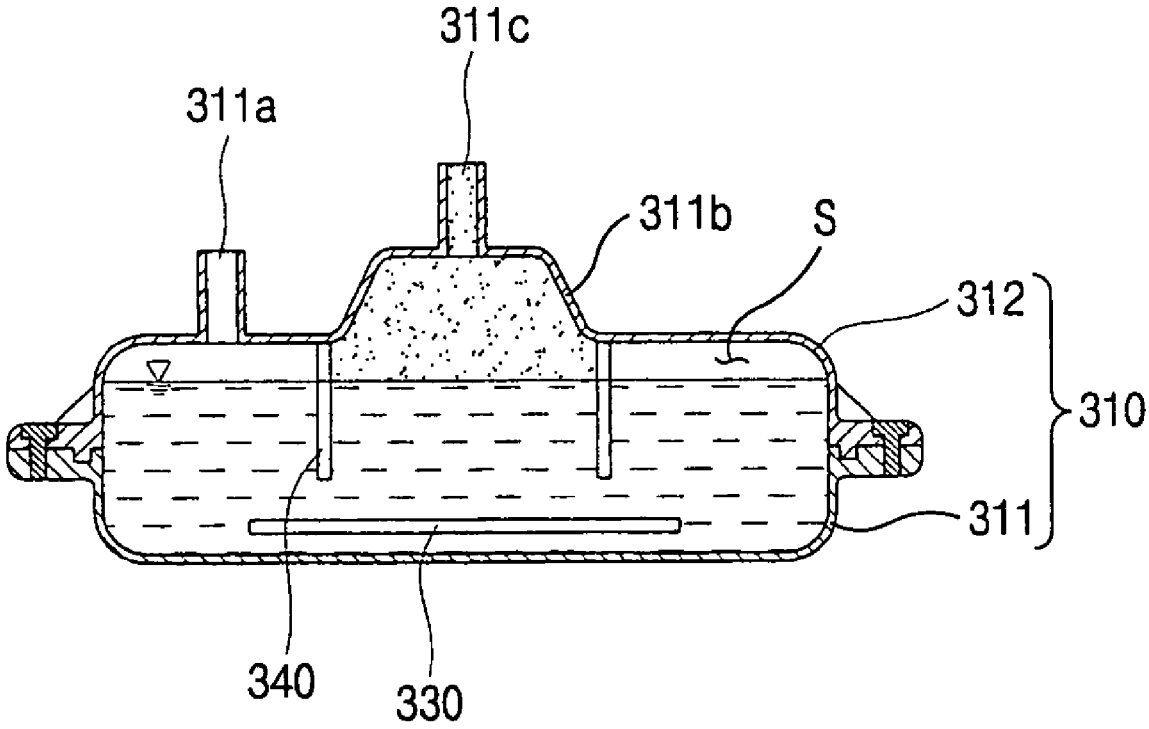
FIG. 7 is longitudinal section view of a vapor generator of a drum type washing machine according to a second embodiment of the present invention.

FIG. 7 is longitudinal section view of a vapor generator of a drum type washing machine according to a second embodiment of the present invention.

As shown, the vapor generator of a drum type washing machine according to another embodiment of the present invention comprises: a case 310 provided with a space portion S for storing water therein, a water supplying portion 311*a* for supplying water at one side of an upper portion thereof, a vapor storing portion 311*b* for storing vapor at another side of the upper portion thereof, and a vapor exhaustion portion 311*c* for exhausting vapor at the vapor storing portion 311*b*; a water level detecting sensor (not shown) installed at the case 310 for detecting a level of water stored in the case 310; a heater 330 installed in the case 310 for heating water stored in the case 310; and a diaphragm 340 formed at an inner upper surface of the case 310.

The case 310 is composed of a lower case 311 and an upper case 312, and the diaphragm 340 introduces vapor generated by the heater 330 into the vapor storing portion 311*b*.

Hereinafter, the drum type washing machine provided with the vapor generator according to the present invention will be explained with reference to FIG. 2.

When a user puts laundry in the drum 103 and powers-on, a quantity of laundry is detected by the sensor (not shown) installed in the cabinet 101 and the second water supplying pipe 101*b* is opened thus to supply water in the tub 102.

At the same time, the driving motor (not shown) is operated thus to rotate the drum 103, and the circulation pump 109 circulates water for a preset time through the drain pipe 107, the second connection hose 108, and the diverging pipe 105 in order to dissolve detergent.

After the water circulation, the vapor generator 200 is operated thus to supply vapor into the drum 103 through the first connection hose 106 and the diverging pipe 105, and the supplied vapor is injected into the drum 103 with a high pressure through the nozzle 105*a*. The vapor injected with a high pressure sterilizes laundry.

The vapor generator 200 can be operated by the user's selection even when water circulation is being performed. By operation of the vapor generator 200, vapor is supplied through the first connection hose 106 and the diverging pipe 105. At this time, wash water introduced into the diverging pipe 105 through the second connection hose 108 is injected with a high pressure into the drum 103 with supplied vapor by the circulation pump 109. Accordingly as wash water is injected into the drum 103 with a high pressure with vapor, laundry can be easily soaked even with a small quantity of water thus to enhance washing efficiency.

Hereinafter, operation of the vapor generator of a drum type washing machine will be explained with reference to FIGS. 3 to 6.

Water is always stored in the case 210, and the water is converted into vapor by the heater 230 and then stored in the vapor storing portion 211*b*. The stored vapor is exhausted to outside of the case 210 through the vapor exhaustion portion 212*a* when it reaches or exceeds a certain pressure.

Figure 6:
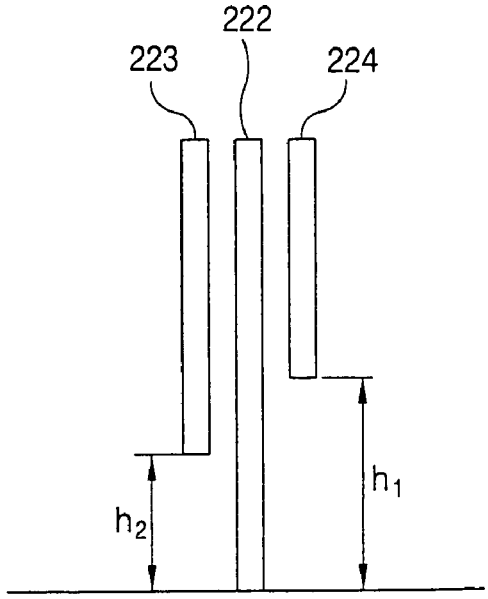
FIG. 6 is a front view showing a detecting rod of the water level detecting sensor.

As shown in FIG. 6, the detecting rod of the water level detecting sensor 222 is composed of the first detecting rod 222, the second detecting rod 223, and the third detecting rod 224. A water supply time point inside of the case 210 an 'on' time point (a driving time point) of the heater 230 are detected by the first and third detecting rods 222 and 224, and an 'off' time point (a driving stopping time point) of the heater 230 is detected by the first and second detecting rods 222 and 223.

That is, water is supplied into the case 210 only until a water level becomes h1, and subsequently, the water supply is shielded. Under the state that water is always stored in the case 210, when the user selects a vapor using mode button, the heater 230 of the vapor generator is heated thus to convert water into vapor.

At this time, the heater 230 is continuously operated until the water level becomes h2, and subsequently, the water supply is automatically stopped.

Said series of operation is repeatedly performed thus to automatically supply water into the case 210 or shield, and the heater 230 is automatically operated thus to generate vapor.

As aforementioned, in the present invention, laundry can be sterilized by using vapor generated by the vapor generator, and wash water where detergent is dissolved can fast soak laundry by using an injection pressure of vapor, thereby efficiently washing laundry with a small quantity of water.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A drum type washing machine comprising:

a drum rotatably installed in a cabinet;

a driving motor installed in the cabinet to rotate the drum;

a vapor generator installed in the cabinet to generate vapor;

a circulation pump installed in the cabinet to circulate wash water drained from the tub;

a diverging pipe installed at an upper side of the drum for supplying vapor generated from the vapor generator and wash water circulated from the circulation pump to an inside of the drum;

a first connection hose to connect the vapor generator and the diverging pipe;

a drain pipe installed at a lower side of the tub to drain wash water inside of the tub; and a second connection hose for connecting the drain pipe and the diverging pipe.

2. The drum type washing machine of claim 1, wherein an injection nozzle is formed at an end portion of the diverging pipe.

3. The drum type washing machine of claim 1, further comprising a selector which is configured to allow a user to select to supply vapor to the drum when water circulation by the circulation pump is performed.

4. The drum type washing machine of claim 1, further comprising a selector to allow a user to select a vapor using mode.

5. The drum type washing machine of claim 1, further comprising:

a tub to hold water in the cabinet;

the drum being rotatably installed in the tub; and a nozzle connected to the diverging pipe, the nozzle being configured to inject the vapor or supply the circulated water to the drum from a upper side of the drum.

6. The drum type washing machine of claim 5, further comprising a controller which controls to supply the vapor and the circulated water to the drum separately from each other in time.

7. The drum type washing machine of claim 5, further comprising a controller which controls to supply the vapor and the circulated water to the drum at a same time.

8. The drum type washing machine of claim 5, further comprising a controller which controls to supply the vapor to the drum while the water is circulated by the circulation pump.

9. The drum type washing machine of claim 5, further comprising a selector to allow a user to select when to supply the vapor to the drum.

10. The drum type washing machine of claim 9, wherein the selector is configured to allow the user to select to supply the vapor to the drum when water circulation by the circulation pump is performed.

11. The drum type washing machine of claim 5, further comprising a selector to allow a user to select a vapor using mode.

* * * * *